United States Patent [19]

Vincent

[11] 4,369,394

[45] Jan. 18, 1983

[54] TIMER CIRCUIT FOR A STROBOSCOPE

[75] Inventor: Andrew W. Vincent, Rochester, N.Y.

[73] Assignee: A. W. Vincent Associates Inc., Rochester, N.Y.

[21] Appl. No.: 220,276

[22] Filed: Dec. 29, 1980

[51] Int. Cl.[3] ..... H05B 37/00

[52] U.S. Cl. ..... 315/200 A; 315/241 S

[58] Field of Search ..... 315/200 A, 241 S, 287

[56] References Cited

U.S. PATENT DOCUMENTS

| | | | |
|---|---|---|---|
| 3,988,635 | 10/1976 | Vincent | 315/200 A |
| 4,149,113 | 4/1979 | Sammis | 315/200 A |
| 4,274,034 | 6/1981 | Conklin | 315/241 R |
| 4,290,048 | 9/1981 | Cutlip et al. | 315/200 A |

*Primary Examiner*—Harold A. Dixon

*Attorney, Agent, or Firm*—Hoffman Stone

[57] ABSTRACT

A variable ramp voltage generated by a first 555 timer is applied to the control electrode of a second 555 timer for controllably varying the delay function of the second timer. The second timer is triggered in accordance with the motion to be observed, several trigger signals being applied during each ramp. The output signals from the second timer are thus timed at progressively longer intervals from the respective input signals during each ramp. The output signals are applied to trigger a stroboscope, producing a cinematographic slow motion view of a selected portion of the motion under observation.

1 Claim, 3 Drawing Figures

TIMER CIRCUIT FOR A STROBOSCOPE

BRIEF DESCRIPTION

This invention relates to a novel and improved circuit for triggering a stroboscope to enable visual observation of any selected portion of the travel of a repetitively moving object with a cinematic slow motion effect generally similar to the effect achieved by the circuit shown in U.S. Pat. No. 3,988,635, issued Oct. 26, 1976 to the present inventor. The present circuit has certain desirable characteristics that represent an improvement over the previously patented circuit.

The circuit includes two timers of the type designated 555, one of which is connected to produce a repetitive ramp voltage, and the second of which is connected to produce an output pulse signal in response to an input pulse signal but delayed relative to the input signal. The second timer is controlled by the ramp voltage generated by the first timer, so that the delay between the input and output signals varies as a function of the ramp voltage. The period of the ramp is set to span several of the input signals, and adjustment means are provided for selectively varying both the period and the amplitude of the ramp as well as the so-called zero level delay produced by the second timer.

The 555 timer, along with many practical circuits using it, is described in detail in the paperback text entitled "IC Timer Cookbook" by Walter G. Jung, published in 1977 by Howard W. Sams and Co., Inc., Indianapolis, Indiana 46268.

An added feature includes a one-and-only-one circuit for enabling stop action photography of the observed motion.

DETAILED DESCRIPTION

Figure 1:
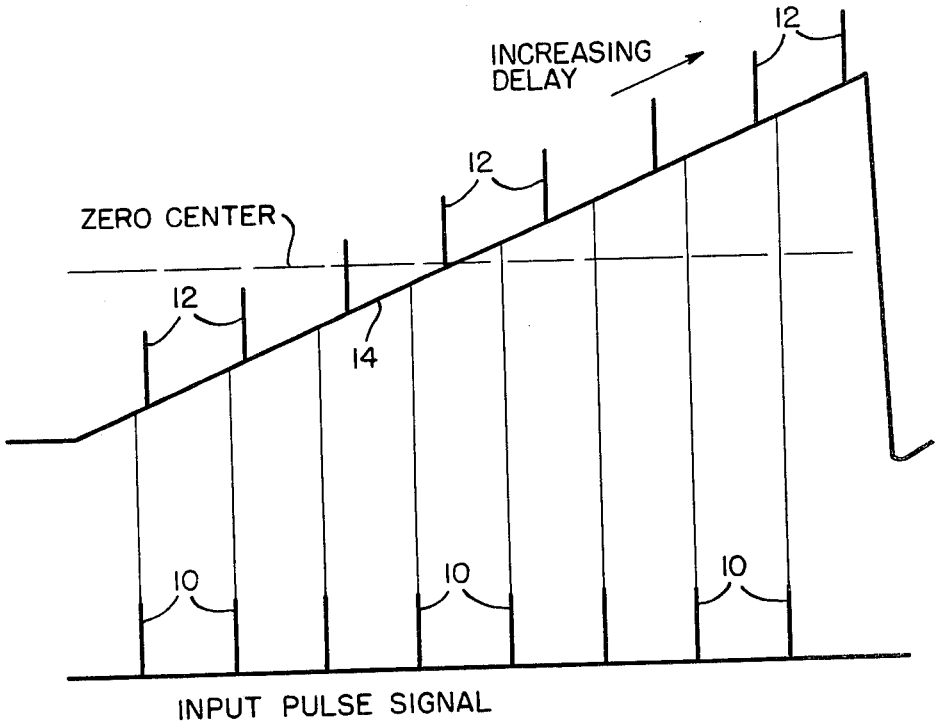
Figure 2A:
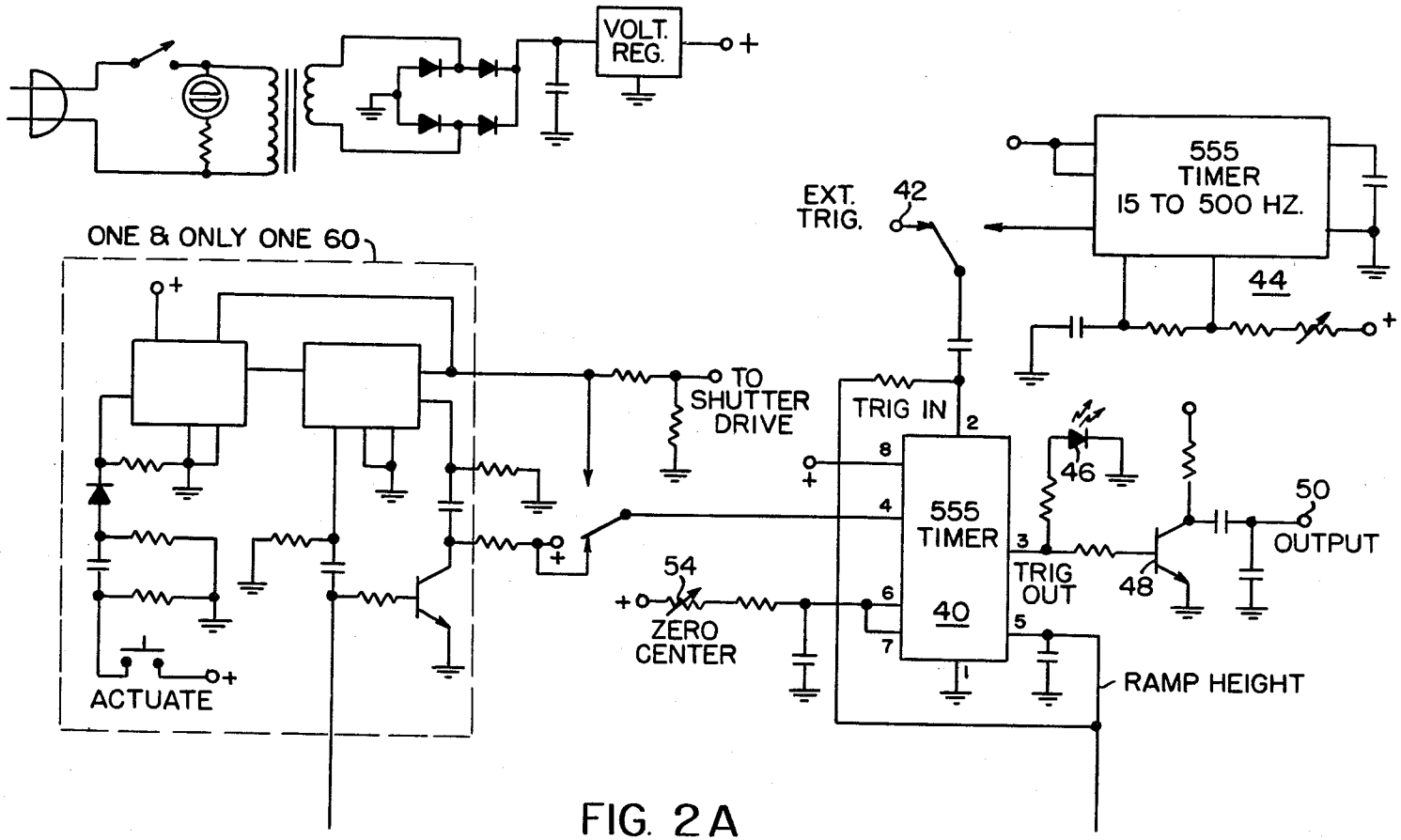
Figure 2B:
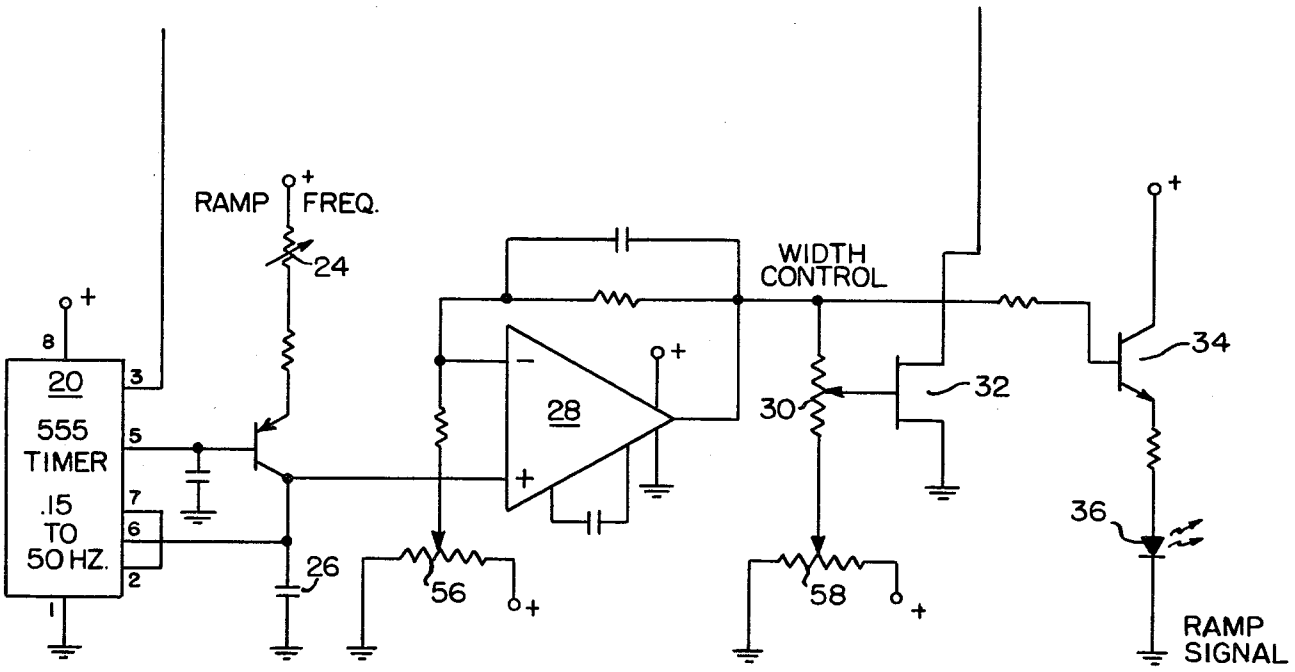

A presently preferred embodiment of the invention will now be described in conjunction with the accompanying drawings, wherein:

FIG. 1 is a chart of voltage wave forms as a function of time illustrating the operation of the circuit; and FIGS. 2A and 2B, taken together with FIG. 2A above FIG. 2B, are a schematic circuit diagram of the timer.

Referring first to FIG. 1, the circuit operates in response to input pulse signals 10, which may be derived from an external sensing device triggered by the object to be observed, or may be generated by an independent oscillator as described hereinafter. Typically the pulses 10 would be derived from some sort of switch (not shown) that momentarily changes state when the object to be observed reaches a selected position in its travel. The output signals 12 produced by the timer circuit are delayed relative to the input signals by varying amounts of time in proportion to the instantaneous values of the ramp voltage 14 at the respective times of occurrence of the input signals. At the start of the ramp the delay between the first input signal and the first output signal is relatively small, while the delay between the last to occur of the input signals and the output signal generated in response to it is relatively long. The ramp 14 persists much longer than the individual input signals, preferably spanning at least ten of them.

The amplitude of the ramp is adjustable, and also its repetition rate. These adjustments enable the operator to select the portion of the travel of the object to be observed. The zero level delay of the circuit is also adjustable to enable the operator to select the central point of the travel to be observed.

Referring now to FIGS. 2A and 2B, a first 555 timer 20 is connected to generate a ramp voltage across a capacitor 26 which is constantly charged through a variable resistor 24, and periodically discharged through the timer 20. The ramp frequency is adjustable by varying the value of the resistor 24.

The ramp voltage is applied to one input of an operational amplifier 28, the output of which is applied through a variable voltage divider 30 to the control electrode of a field effect transistor 32. The output of the amplifier 28 is also applied to the base of another transistor 34, which drives a light emitting diode 36 to provide a visible indication of the ramp signal for the operator. As the ramp progresses the diode 36 becomes progressively brighter.

The output of the field effect transistor 32 is applied to the control terminal of the second 555 timer 40 for varying the delay function of the timer 40 in accordance with the ramp voltage 14. As the ramp progresses the delay function of the timer increases. The second timer 40 may be triggered from an external trigger source (not shown) connected to the trigger input terminal 42, or, alternatively, by a separate variable pulse generator 44. The output of the second timer 40 is applied to a light emitting diode 46 to provide a visual indication of the output pulses for the operator, and through a transistor 48 and an output terminal 50 to a stroboscope for triggering or driving it.

The amplifier 28 is arranged to hold the instantaneous voltage at the center of the ramp, indicated by the dashed line 52 in FIG. 1, at an approximately constant value through the entire range of adjustability of ramp frequency and amplitude. Ramp height, or amplitude, is apparent in operation of the circuit by the width, or extent, of the travel of the object under observation that is seen by the observer. For example, if it is desired to inspect a rotating shaft along a portion of its travel at, say, 180° from a reference position, and a trigger pulse is generated whenever the shaft reaches the reference position, the width control voltage divider 30 may be set at zero and the zero center control 54 adjusted so the second timer produces an output pulse each time the shaft reaches the 180° position. The shaft then appears to the observer to be stationary at its 180° position. As the width control 30 is then moved away from its zero position the amplitude of the ramp voltage 14 increases and the shaft is seen as moving slowly from a position short of its 180° position, through that position and beyond. The effect is symmetrical, the "window" of observation appears to the observer to widen, expanding equally on both sides of the 180° position.

This symmetry of operation, keeping the zero center always near the middle of the ramp, is achieved by adjustment of the variable voltage dividers 56 and 58, which control the bias on the amplifier 28 and the field effect transistor 32.

A one-and-only-one circuit portion 60 is also provided to facilitate stop action photography of the object under observation. In this mode the reset terminal of the second timer 40 is switched from its normal direct connection to the current source to the output terminal of the one-and-only-one circuit so that the timer 40 is enabled only during the period of a single ramp. The output terminal of the first timer 20 is connected to trigger the one-and-only-one circuit on the trailing edge of the ramp in progress when the actuate switch 62 is momentarily closed. The output of the one-and-only-one circuit is applied to the reset terminal of the second timer 40 and to an accessory output terminal 64 to hold the timer 40 enabled and to drive an accessory such as a camera shutter (not shown) opening it and holding it open, during the time occupied by the single ramp following the first to occur.

What is claimed is:

1. A timer circuit for triggering a stroboscope at successively longer intervals following the occurrence of preselected repetitively occurring events comprising a first 555 timer, an RC circuit, means for charging the capacitor of the RC circuit through the resistance thereof thereby to generate a ramp voltage across the capacitor, said capacitor being connected to said timer to be periodically discharged thereby so that the ramp voltage is generated repetitively, the resistance in said RC circuit being variable so that the repetition rate of the ramp voltage varies in response to changes of the resistance, an amplifier having an input connected to the capacitor of said RC circuit for amplifying the ramp voltage, said amplifier including feedback and bias control means for holding the instantaneous value of the ramp voltage at the center of the ramp approximately at a constant, preselected value, a second 555 timer, variable means for applying a selectable fraction in amplitude of the ramp voltage from said amplifier to the control input of said second timer, means for applying a trigger signal to said second timer synchronously with the preselected repetitively occurring events, and output means for applying the output signals of said second timer to a device such as a stroboscope to be periodically triggered.

* * * * *